US005868555A

United States Patent [19]

Shimotomai

[11] Patent Number: 5,868,555

[45] Date of Patent: Feb. 9, 1999

[54] HYDRAULIC DRIVE UNIT OF A PRESS MACHINE AND A SWASH PLATE TYPE VARIABLE CAPACITY AXIAL PISTON PUMP TO USE FOR SAID DEVICE

[75] Inventor: Mitsuhiro Shimotomai, Aichi, Japan

[73] Assignee: Nisshinbo Industries, Inc., Tokyo, Japan

[21] Appl. No.: 740,610

[22] Filed: Oct. 31, 1996

[30] Foreign Application Priority Data

Nov. 13, 1995 [JP] Japan ..... 7-319629
Nov. 13, 1995 [JP] Japan ..... 7-319631

[51] Int. Cl.[6] ..... F04B 1/26

[52] U.S. Cl. ..... 417/222.1; 92/12.2; 60/443

[58] Field of Search ..... 417/222.1; 60/443; 74/839; 91/505; 92/12.2

[56] References Cited

U.S. PATENT DOCUMENTS

| | | | |
|---|---|---|---|
| 3,365,886 | 1/1968 | Moon | 60/443 |
| 3,941,514 | 3/1976 | Louis | 417/222 |
| 3,972,188 | 8/1976 | Jessee | 60/443 |
| 4,072,442 | 2/1978 | Horiuchi | 417/218 |

FOREIGN PATENT DOCUMENTS

| | | |
|---|---|---|
| 1118053 | 6/1968 | United Kingdom . |
| 1175072 | 12/1969 | United Kingdom . |
| 993882 | 6/1995 | United Kingdom . |

*Primary Examiner*—Charles G. Freay
*Attorney, Agent, or Firm*—Kubovcik & Kubovcik

[57] ABSTRACT

A hydraulic drive unit of a press machine and a swash plate type variable capacity axial piston pump to use for a hydraulic drive unit. Discharge of the pump and the direction of the hydraulic pressure can be controlled at high speed, and the direction of the hydraulic pressure and the timing of the discharge can coincide. The selector device 12 that includes spool valves in parallel is used in place of a servo valve. An electric motor 30 for driving the pump and cam of the axial piston pump 11 and an electric motor 47 for driving the selector cam of the selector device 12 are controlled cooperatively by commands from the numerical control device 14. Two spools 44*a*, 44*b* of the selector device 12 perform changeover actuation alternately. Synchronous control of the discharge of the axial piston pump 11 and the flowing direction change of working fluid to the hydraulic pressure cylinder 1 are done, so that the piston 1*a* of the hydraulic pressure cylinder 1 is made to move up and down.

3 Claims, 7 Drawing Sheets

HYDRAULIC DRIVE UNIT OF A PRESS MACHINE AND A SWASH PLATE TYPE VARIABLE CAPACITY AXIAL PISTON PUMP TO USE FOR SAID DEVICE

BACKGROUND OF THE INVENTION

This invention relates to a hydraulic drive unit of a press machine such as a turret punch press that reciprocates a ram at high speed. Moreover, this invention relates to a swash plate type variable capacity axial piston pump improved with respect to the control drive of the pump discharge.

RELATED ART STATEMENT

For a hydraulic drive unit of a press machine, such as a turret punch press that reciprocates a ram at high speed, in general, a solenoid controlled pilot selector is adopted for changing the flow of pressure oil.

However, there is a delay in response with the solenoid controlled pilot selector. Therefore, when processing with the press machine is accomplished at a high frequency, in other words, when one cycle time of the press machine is to be shortened and productivity is to be improved, a servo valve must be used to speedup the process.

FIG. 11 shows an oil hydraulic circuit of a hydraulic drive unit of a press machine of the related art in which a servo valve is used. In FIG. 11, numeral 1 is a hydraulic cylinder, 2 is a servo valve, and 3 is a main pump. A discharge mouth of the main pump 3 is connected with a P-port of the servo valve 2, and an A-port and a B-port of the servo valve 2 are connected respectively with the hydraulic cylinder 1. A piston 1*a* of the hydraulic cylinder 1 is made to move up and down by this connection.

The flow rate of pressure oil that passes through the servo valve 2 is controlled by electrical or electronic commands from an amplifier 4 for discharge control. Relief of working fluid from an electric current proportion control relief valve 5 set up in the discharge side of the main pump 3 to a tank 6 is accomplished by a pressure corresponding to a command from a relief pressure control amplifier 7. In the figure, numeral 8 is a pump for a pilot pressure of the servo valve 2, and numeral 9 is a relief valve for the pilot pressure, and 10 is the main motor that drives the main pump 3. Speedup is attained in the system of FIG. 11 by using the servo valve.

However, the servo valve squeezes the working fluid to control its flow rate. Therefore, pressure loss in the servo valve is big, and the efficiency of the system is decreased. Moreover, working fluid to return from the electric current proportion control relief valve 5 to the tank 6 causes power loss in this system. Therefore, in the above-mentioned system where a servo valve was adopted, the capacity of a main motor 10 that drives the main pump 3 must be enlarged. Namely, in the hydraulic drive unit of the related art, there is a useless part where obviously the efficiency of the system is made worse, thus it is difficult to compose the system suitably.

It is tried therefore controlling the discharge of working fluid by using a swash plate type variable capacity axial piston pump for decreasing the power loss. As is well known in the art, a discharge of the swash plate type variable capacity axial piston pump is controlled by changing an angle of inclination of a cam plate with a piston. In general, the swash plate type variable capacity axial piston pump drives the piston by pulling the pressure of working fluid which it itself discharged into the piston. This is called the pressure control compensation mechanism or compensator. Therefore, the time until discharge pressure stands up becomes the delay. Therefore, when a ram reciprocates at high speed to make blanking processing and other processing, it is difficult to control the discharge of the pump so that it can follow the processing speed fully. The power loss can not be decreased fully, too.

If an exclusive pump, a valve and so on which drive the piston to make ramp the swash plate are set up separately, and if pressure is always made to occur to control the piston, enough responsibility can be secured. In this case, however, the power always becomes necessary with the exclusive pump, the valve, and so on. Therefore it is not still efficient.

SUMMARY OF THE INVENTION

An object of the present invention is to provide a hydraulic drive unit of a press machine and a swash plate type variable capacity axial piston pump to use for said device, in which the discharge of the pump can be controlled variably at high speed, the hydraulic direction can also be controlled at high speed and the direction of the hydraulic pressure and the timing of the discharge can be made to coincide.

Another object of the present invention is to provide a hydraulic drive unit of a press machine and a swash plate type variable capacity axial piston pump to use in said device, in which working fluid returned to a tank through a relief valve is hardly made to occur, the power loss is small and, therefore the power efficiency is improved.

According to the present invention, there is provided a hydraulic drive unit of a press machine, comprising; a hydraulic pump and a selector; said hydraulic pump being a swash plate type variable capacity axial piston pump; said selector is a spool valve; a variable means made to wear the angle of inclination of the swash plate to control the discharge of said axial piston pump; said variable means comprising a piston which locates an angle of inclination of said swash plate by its one end touching said swash plate; a first movement conversion means that is connected with another end of said piston to convert a rotation or oscillation movement of said piston to there linear motion; a first actuator for rotation or oscillation connected with said movement conversion means; a changeover drive means of said spool valve; said changeover drive means comprising a second movement conversion means that is connected with one end of said spool of said spool valve to convert rotating motion to linear motion; and a second actuator for rotation or oscillation connected with said movement conversion means; whereby said first and the second actuator actuate cooperatively.

The hydraulic drive unit of the press machine of the present invention does not squeeze working fluid that the hydraulic pump discharged. Therefore, the drive unit of this invention can control the actuation velocity of the hydraulic cylinder and the direction of the hydraulic pressure. Therefore, return of pressure oil through the relief valve to the tank hardly occurs in the press machine operation. Therefore, the power loss decreases drastically. The drive unit of the present invention can cope with high-speed actuation because a spool valve of the pressure loss of which is smaller than the servo valve is being used. The drive unit of the present invention can improve the power efficiency.

According to the present invention, there is provided a swash plate type variable capacity axial piston pump; including a variable means made to vary an angle of inclination of a swash plate; said variable means comprising; a piston which locates an angle of inclination of said swash plate by its one end touching said swash plate, a movement conversion means that is connected with another end of said piston to convert a rotation or oscillation movement of said piston to linear motion, and an actuator for rotation or oscillation connected with said movement conversion means.

The swash plate type variable capacity axial piston pump of the present invention can vary the angle of inclination of the swash plate variably by not using the pressure of working fluid discharged from the pump itself. Therefore, the delay until the pump's own discharge pressure reaches regular pressure does not affect the location of the piston. The discharge of the pump can be controlled at variable high speed by actuating an actuator at high speed. Moreover, even if the pressure of working fluid becomes large in a moment, only a reactive force corresponding to the pressure change is applied to the actuator. Therefore, the piston can be driven efficiently.

BRIEF DESCRIPTION OF THE DRAWINGS

These and other objects and advantages of the present invention may be fully understood and appreciated in conjunction with the attached drawings and the following detailed description of the preferred embodiments where the same numerals are employed to denote the same or similar features.

DETAILED EXPLANATION OF PREFERRED EMBODIMENTS

Figure 1:
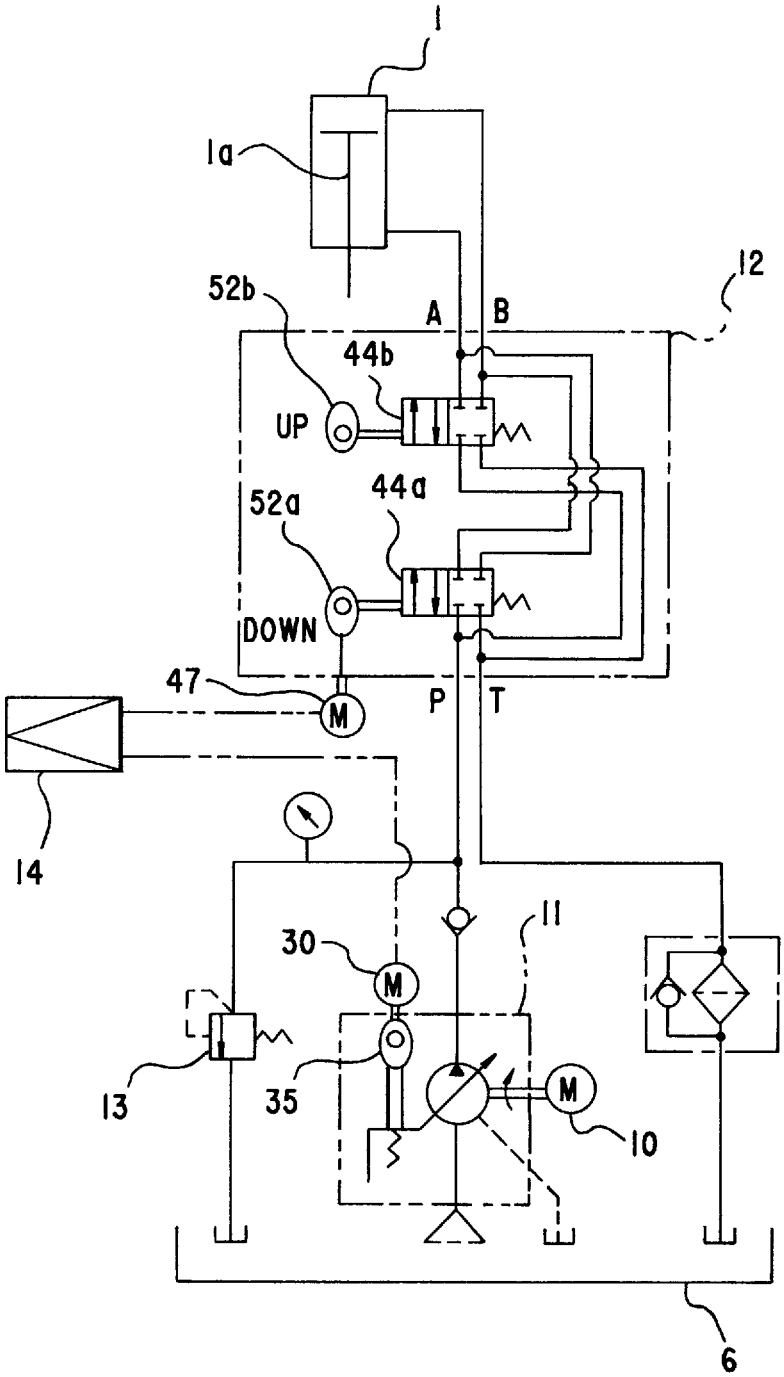
FIG. 1 shows an oil hydraulic circuit of the first embodiment of a hydraulic drive unit of a press machine of the present invention.

Some embodiments of this invention are explained referring to the drawings in the following.

FIG. 1 shows an oil hydraulic circuit of the first embodiment of the hydraulic drive unit of the press machine of the present invention. The first embodiment device provides a swash plate type axial piston pump 11 of a variable capacity type as a hydraulic pump. And, the first embodiment device provides a selector device 12 that provides spool valves in parallel, in place of the servo valve. The discharge port of this axial piston pump 11 is connected with a P-port of the selector device 12. A A-port and the B-port of the selector device 12 are connected with the hydraulic cylinder 1 respectively. Therefore, two spools of the selector device 12 perform changeover actuation alternately, and the piston 1*a* of the hydraulic cylinder 1 is made to move up and down by this actuation. A relief valve 13 is provided in the discharge side of the axial piston pump 11.

Relief valve 13 is a safety valve set in the allowable maximum pressure to protect the apparatus included in the circuit. Therefore, if it is not an abnormal condition, working fluid may not flow out from the relief valve 13. A numeral 14 in the figure shows a numerical control device. A servomotor to drive a pump and a cam of the axial piston pump 11 and a servomotor to drive a cam of a selector of the selector device 12 are controlled cooperatively based on commands from the numerical control device 14. Therefore, the discharge amount of the axial piston pump 11 and the flow direction of working fluid to the hydraulic cylinder 1 can be controlled cooperatively.

Figure 2:
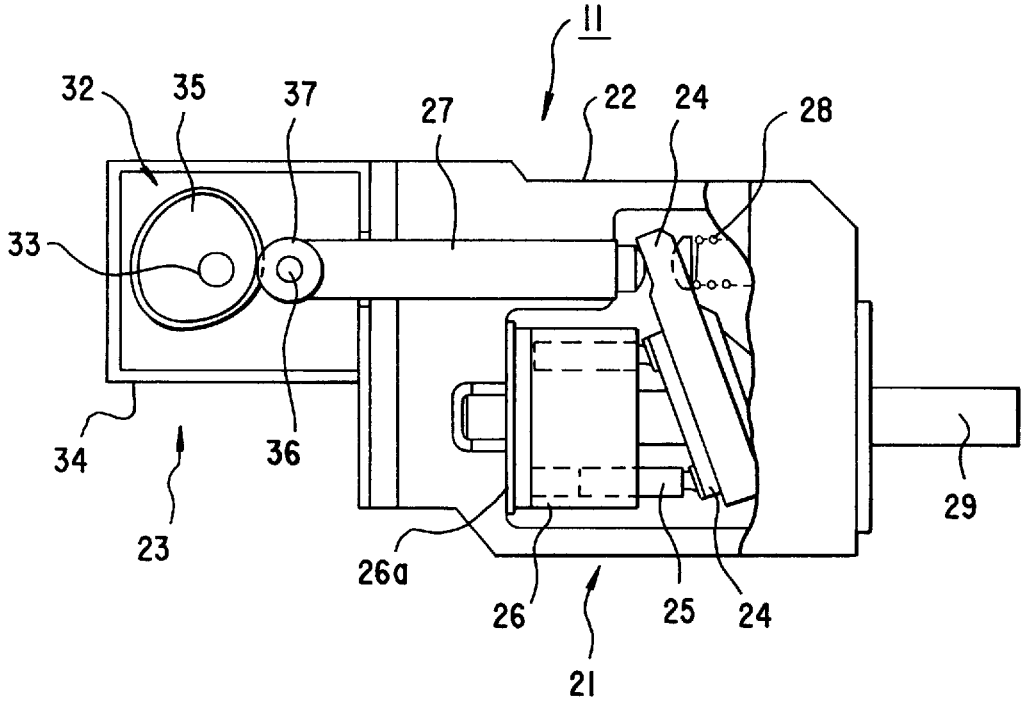
FIG. 2 shows a partially sectional side elevation of an axial piston pump of the present invention shown in FIG. 1.
Figure 3:
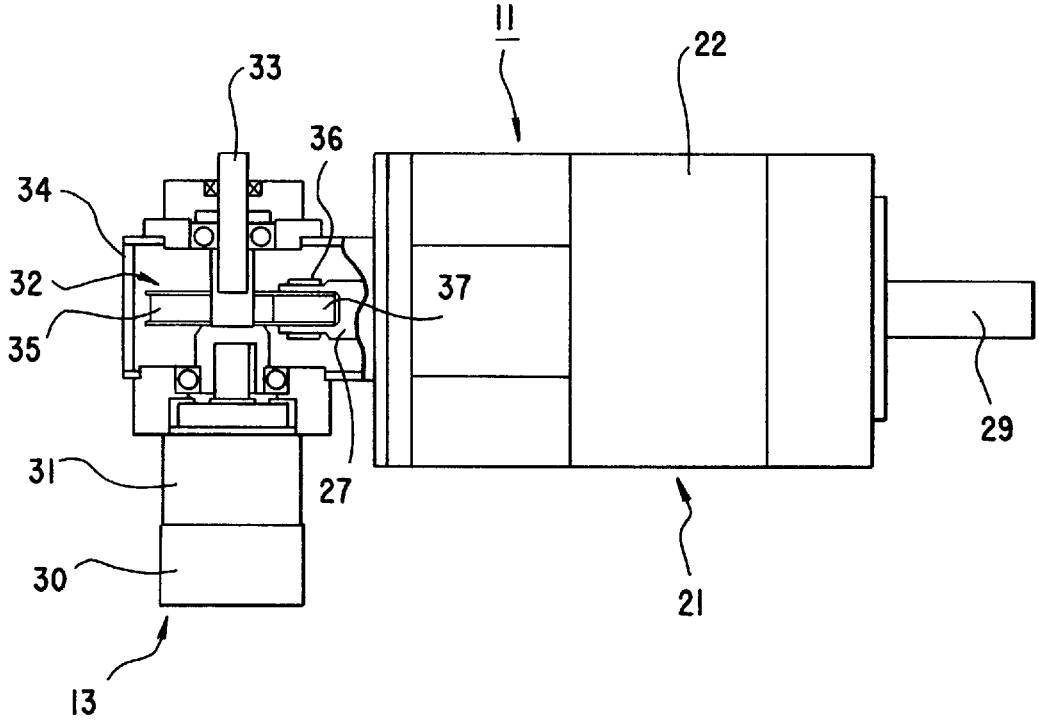
FIG. 3 shows a partially sectional plan view of the axial piston pump of the present invention shown in FIG. 1.

FIG. 2 shows a partially sectional side elevation of the axial piston pump of the invention shown in FIG. 1, and FIG. 3 is the partially sectional plan view of the axial piston pump of the invention shown in FIG. 1. An axial piston pump 11 comprises mainly from the pump body 21 and the discharge control device 23 fixed outside the casing 22 of the pump body 21.

In the casing 22 of the pump body 21, a cam plate 24, a cylinder block 26 having plural pistons 25, a piston 27 for changing an angle of inclination of the cam plate 24, and a spring 28 that holds the cam plate 24 with the piston 27 for pressing it to return are provided. An input shaft 29 is inserted from one side of the casing 22, and it penetrates the cam plate 24. This input shaft 29 is connected with the cylinder block 26 using a spline connection (not shown) and so on for rotating together with the cylinder block 26. Further, a numeral 26*a* shows a valve plate and a numeral 24*a* shows a shoe in the figures.

The discharge control device 23 comprises from an electric motor 30, reduction gears 31 and a movement converter 32. The movement converter 32 is a means that converts rotating motion to linear motion. A rotating shaft 33 that is rotated by the electric motor 30 through the reduction gears 31 is pivoted in the inside of a casing 34. A plate cam 35 is fixed on this rotating shaft 33.A roller follower 37 is installed rotatably in the proximal end of the piston 27 with the pin 36. This roller follower 37 is contacted with the plate cam 35. Any cam other than the plate cam illustrated can be adopted. A servomotor can be adopted as a means for driving these conversion means in oscillation or in rotation. Of course, an oil hydraulic motor, a hydraulic motor or an oscillation actuator can be adopted as the drive means, too.

Namely, this axial piston pump 11 makes the angle of inclination of the cam plate 24 change by; rotating the rotating shaft 33 by the electric motor 30 through the reduction gears 31, then, rotating the plate cam 35 a predetermined angle, then, competing or cooperating with the pressing force of the spring 28, moving the piston 27 along its own axis. The stroke of the piston 25 of the cylinder block 26 will be changed at high speed by deciding the position of the cam plate 24 by rotating the electric motor 30 at high speed. Therefore, the discharge of the axial piston pump 11 is controlled to change at high speed.

Figure 4:
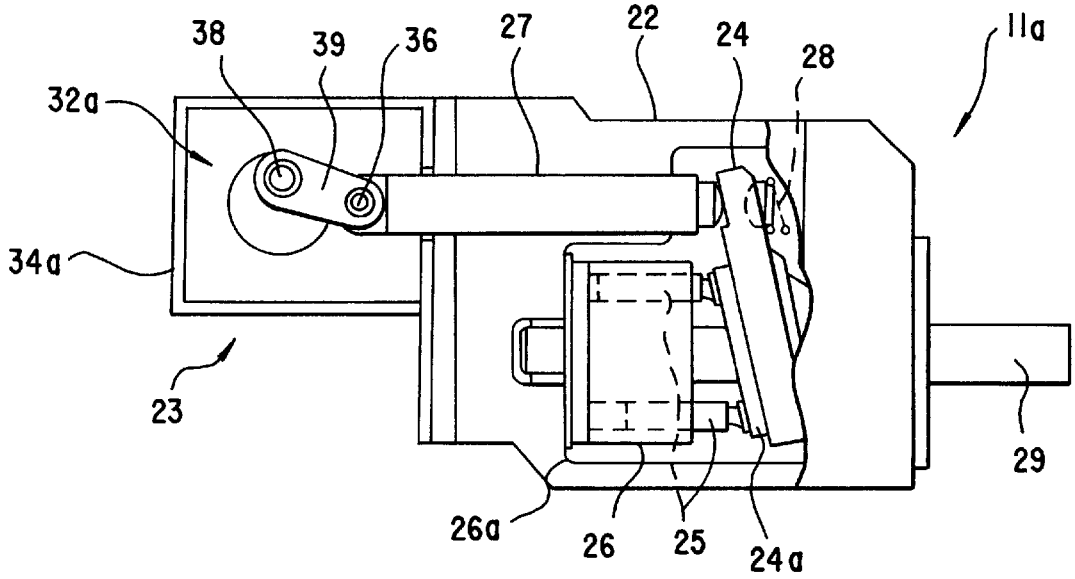
FIG. 4 shows a side partially sectional view of another axial piston pump of the present invention.

FIG. 4 shows a partially sectional side view of another axial piston pump of the present invention. In a swash plate type variable capacity axial piston pump 11*a* of this embodiment, a cam mechanism and, a slider-crank chain is used as the movement converter. In this pump, by connecting a crank shaft 38 with the proximal end of the piston 27 through the pin 36 and the connecting rod 39, the piston 27 can be moved reciprocally. Because other configurations and actuation are the same as the pump of the first embodiment, explanations about them are omitted.

Figure 5:
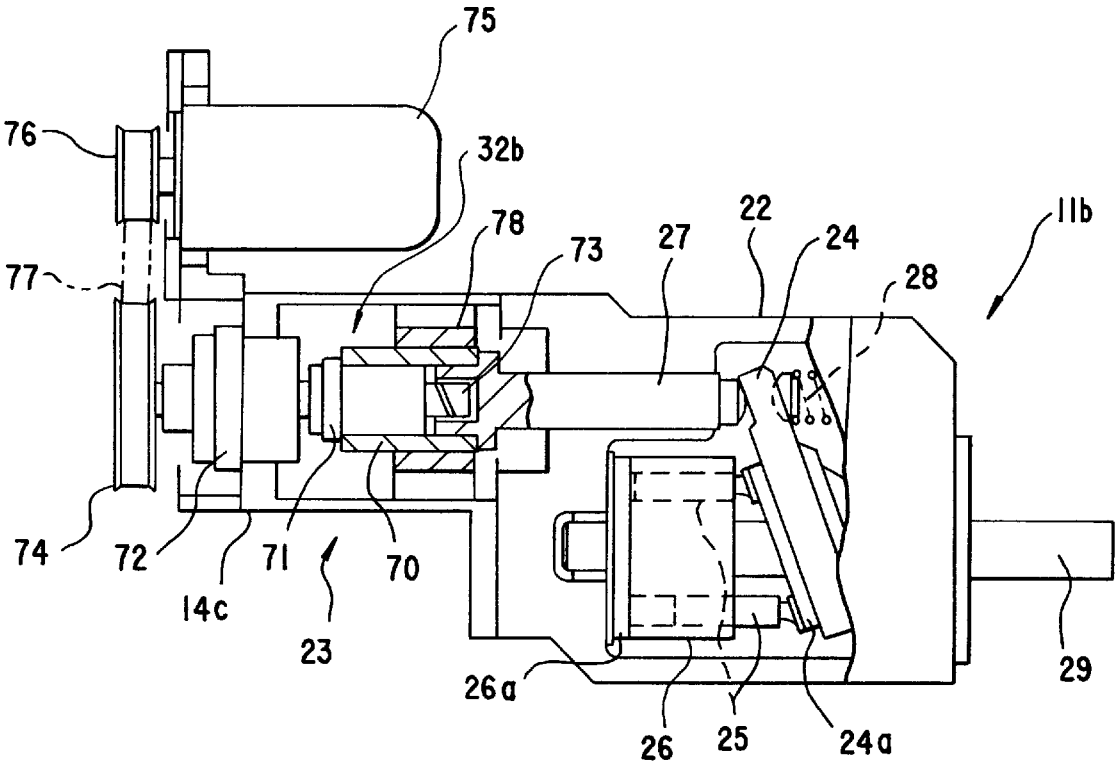
FIG. 5 shows a side partially sectional view of still another axial piston pump of the present invention.

FIG. 5 shows a partially sectional side view of still another axial piston pump of the present invention. In the swash plate type variable capacity axial piston pump 11*b* of this embodiment, for the cam mechanism or for the slider-crank chain of the prescribed embodiments, a ball screw mechanism is used as the movement converter. A ball screw nut 71 is installed in a proximal end of the piston 27 through a ball screw nut case 70. A ball screw 73 is installed in a casing 14*c* of the movement converter 32*b* through a bearing unit 72. A ball screw 73 is driven by a belt 77 situated between a pulley 74 and a pulley 76. The pulley 74 is installed in the edge part of the ball screw 73 that projects to the outside of the casing 14*c*. The pulley 76 is installed on an output shaft of an electric motor 75 supported in the casing 14*c*. And, in the figure, a numeral 78 is a sliding member. This is installed in the casing 14*c* to guide the sliding of the ball screw nut case 70. Because other configurations and actuations are the same as the pump of the first embodiment, explanations about them are omitted.

Though not illustrated, publicly known various movement conversion means can be employed as a movement converter.

Figure 6:
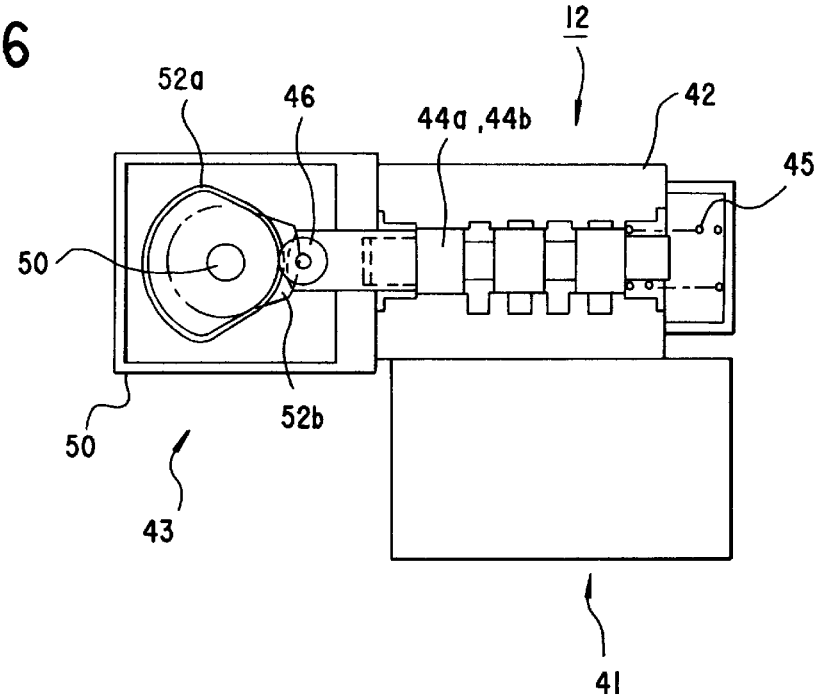
FIG. 6 shows a front sectional view of a selector device shown in FIG. 1.
Figure 7:
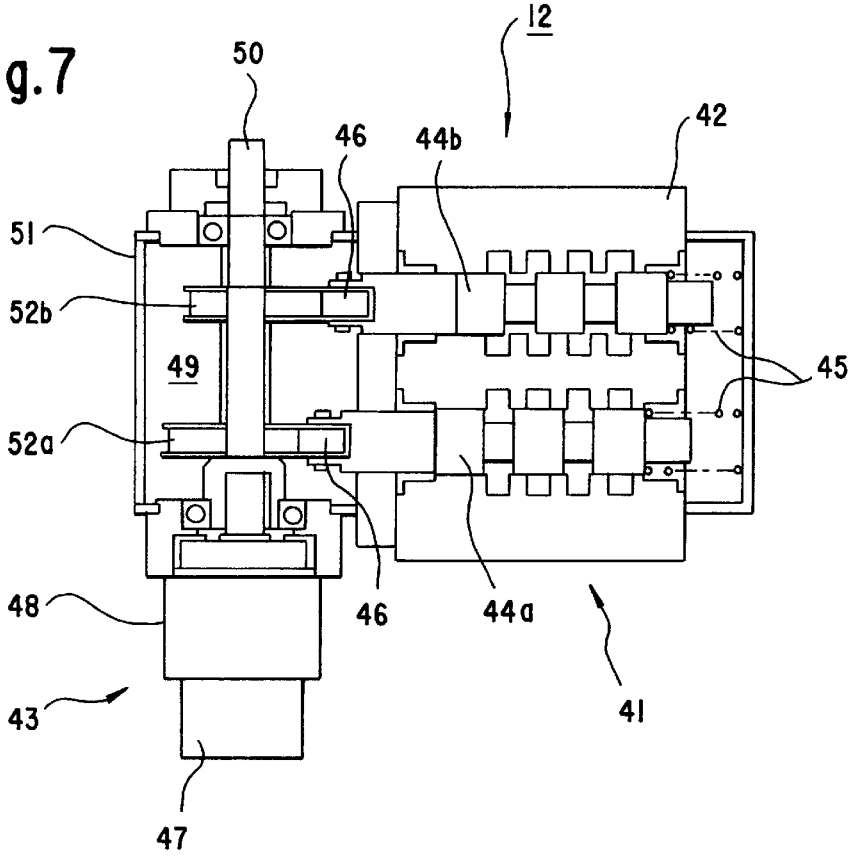
FIG. 7 shows a plane sectional view of a selector device shown in FIG. 1.

FIG. 6 is a front face sectional view of the selector device 12 of FIG. 1, and FIG. 7 is a plane sectional view of the selector device 12 of FIG. 1. This selector device 12 comprises mainly a valve body 41 and an actuation control device 43 fixed outside a casing 42 of the valve body 41.

A pair of two position four port spools 44*a*, 44*b* are arranged in the casing 42 in the inside of the valve body 41 in parallel. Each one end of those spools 44*a*, 44*b* is pressed with the spring 45 toward the other end side. And, a roller follower 46 is pivoted freely rotatable at the other end of each spool 44*a*, 44*b*.

The actuation control device 43 comprises an electric motor 47, a reduction gear 48 and a movement converter 49. The movement converter 49 is a means that converts rotating motion to linear motion. A rotating shaft 50 driven to rotate through the reduction gear 48 by the electric motor 49 is pivoted in the inside of a casing 51. Plate cams 52*a*, 52*b* are installed on this rotating shaft 50 with a fixed space. The roller followers 46, 46 set up at the other edge of the spool 44*a*, 44*b* are contacted with each of these plate cams 52*a*, 52*b*. Of course the space between the plate cams 52*a*, 52*b* corresponds with the space between the spools 44*a*, 44*b*. The phase of the cam curve of the plate cams 52*a*, 52*b* have a difference of 180 degrees from each other as illustrated. Therefore, while a rotating shaft 50 rotates by one, the spools 44*a*, 44*b* accomplish changeover actuation alternately. A servomotor and the like can be adopted as the electric motor 47. It is not necessary to isolate the plate cams 52*a*, 52*b* completely. The plate cams 52*a*, 52*b* may be unity types. A plate cam 52*a*, 52*b* may have the cam curve of the pair in 2 position where it was left in the shaft direction of the rotating shaft 50.

As stated above, the selector device 12 makes the piston 1*a* of the hydraulic cylinder 1 move up and down by moving the spools 44*a*, 44*b* alternately by the plate cams 52*a*, 52*b*. Namely, each port is blocked under the condition of FIG. 1. The electric motor 47 rotates the rotating shaft 50 in the right turn from this condition. At this time, it is in the condition that the cam curve of one plate cam 52*b* goes to the apex from the extreme bottom point. Therefore, the spool 44*b* is pushed by the plate cam 52*b*. Then, the spool 44*b* is moved in the right direction with going against the pressing force of the spring 45. Then, an A-port is connected to a P-port and a B-port is connected to a T-port, thus working fluid is supplied to the lower chamber of the hydraulic cylinder 1. Then, the piston 1*a* is raised up. As the piston 1*a* raises, working fluid in the upper chamber of the hydraulic cylinder 1 is returned to the tank 6 through the B-port. The plate cam 52*a* is rotated by the same velocity with the plate cam 52*b*, too. However, the displacement of the cam curve of the plate cam 52*a* for the time interval of the above mentioned actuation is zero. Therefore, the spool 44*a* is not moved, and each port is kept in the blocked condition. Therefore, working fluid is not supplied to the upper chamber of the hydraulic cylinder 1. Thus, the rise actuation of the piston 1*a* is not blocked.

As the rotating shaft 50 rotates further, the displacement direction of the cam curve of the plate cam 52*b* goes to the extreme bottom point from the apex. Then, the spool 44*b* is returned to the port blocked condition shown in FIG. 1 by the depressing force of the spring 45. Therefore, the working fluid stops being supplied to the lower chamber of the hydraulic cylinder 1. On the other hand, the displacement direction of the cam curve of the plate cam 52*a* goes to the apex from the extreme bottom point. Then, the spool 44*a* is moved by the cam 52*a* in the right direction against the pressing force of the spring 45. Then, the A-port and the P-port and the B-port and the T-port are connected with each other, and working fluid is supplied to the upper chamber of the hydraulic cylinder 1. Then, the piston 1*a* descends. As the piston 1*a* descends, working fluid in the lower chamber of the hydraulic cylinder 1 is returned to the tank 6 through the B-port. The spool 44*b* is not moved, and it keeps the port blocked condition after it is returned in the port blocked condition because the displacement of its cam curve is zero. Therefore, working fluid is not supplied to the lower chamber of the hydraulic cylinder 1, and the descent of the piston 1*a* is not obstructed.

The above actuation is repeated at high speed caused by the rotation of the rotating shaft 50.

Then, the electric motor 30 of the axial piston pump 11 and the electric motor 47 of the selector device 12 are controlled cooperatively according to commands from the numerical control device 14. Therefore, the discharge of the axial piston pump 11 and the direction of working fluid to the hydraulic cylinder 1 are controlled cooperatively. Therefore, the hydraulic cylinder 1 can be driven without squeezing the working fluid discharged from the axial piston pump 11. Working fluid returned to the tank 6 through the relief valve 13 hardly occurs. And, the power efficiency as a system improves because the pressure loss of the selector device 12 is smaller than a servo valve.

Figure 8:
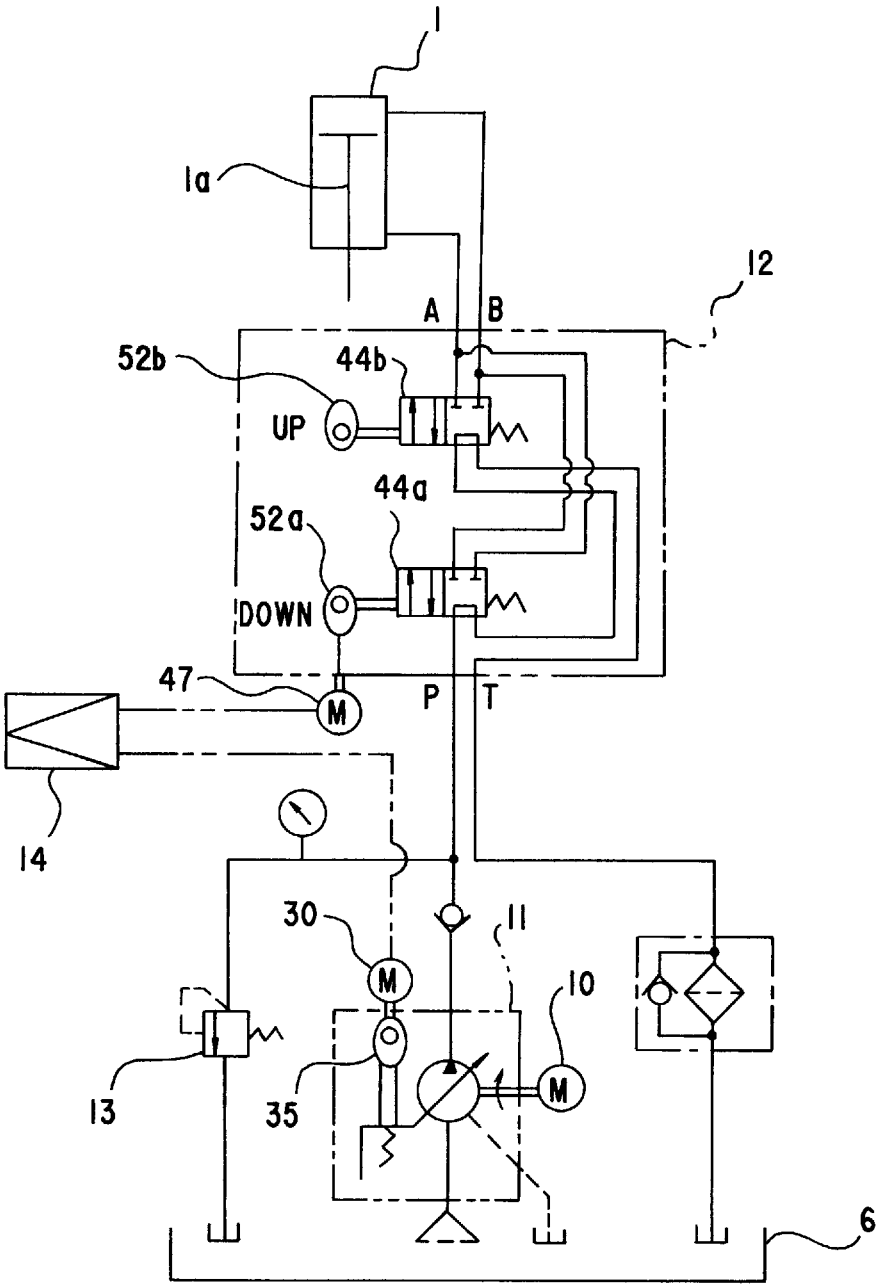
FIG. 8 shows an oil hydraulic circuit of the second embodiment of a hydraulic drive unit of a press machine of the present invention.

FIG. 8 is the oil hydraulic circuit figure of the second embodiment of the hydraulic drive unit of the press machine of the present invention. The device of this embodiment has a similar configuration with the above-mentioned first embodiment. But, only the point that a P-port and a T-port are connected in the selector device 12 is different. Therefore, in a condition that the selector device 12 is off, namely, when each of the spools 44*a*, 44*b* is in its detent position, the working fluid discharged from the axial piston pump 11 is returned to the tank 6 through the T-port from the P-port. Therefore, the pressure of the pipe line system does not rise up. Therefore, in a condition that the selector device 12 is off, even if the discharge of the axial piston pump 11 is enlarged in advance, the discharge pressure of the pump 11 is not increased. The actuation of the selector device 12 is made to start from such the condition. It means that acceleration at the instant when the piston 1*a* of the hydraulic cylinder 1 starts actuation can be set large. Therefore, one cycle time of the actuation is shortened, thus, the productivity of the press machine that the present invention was applied to is increased.

Figure 9:
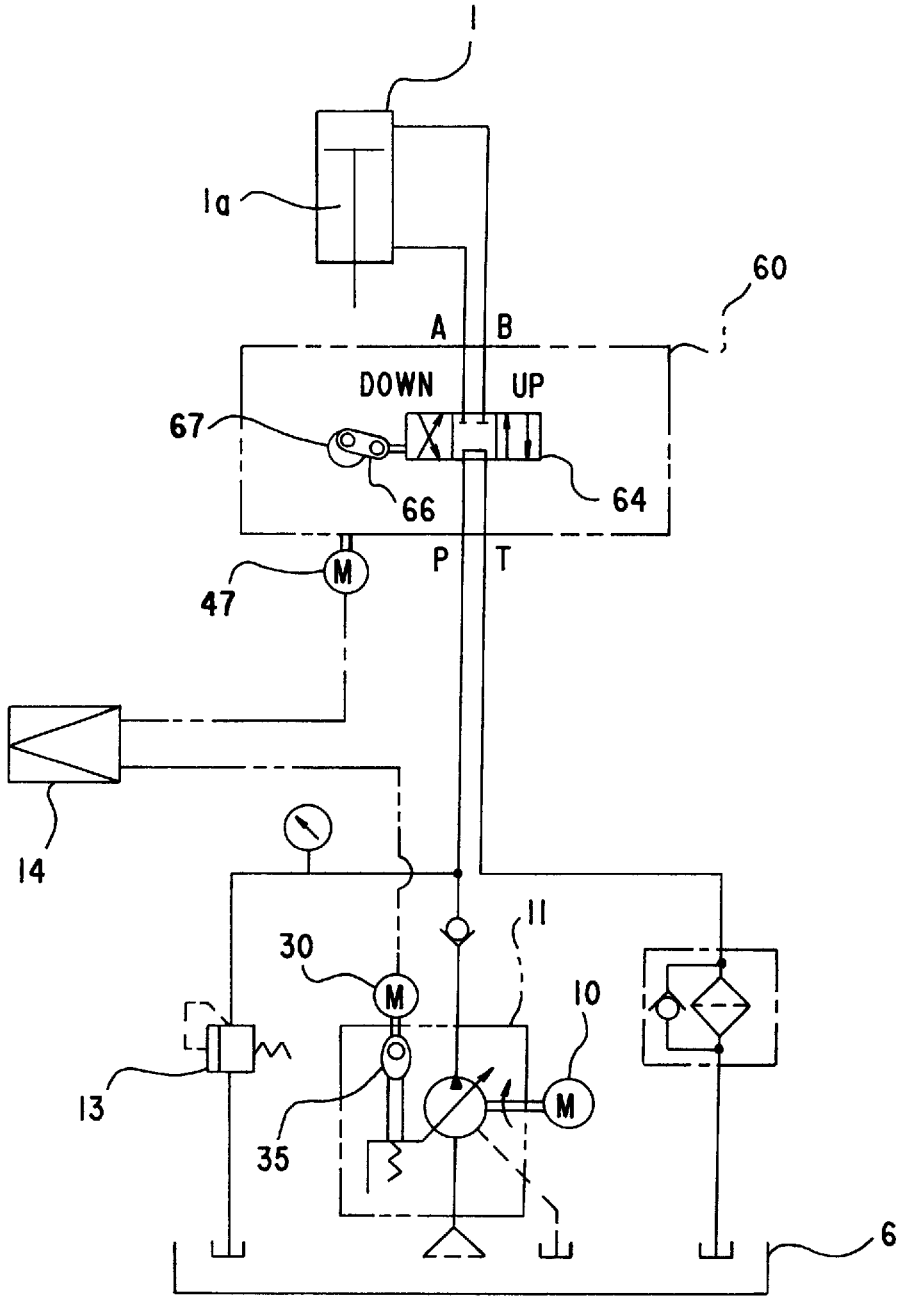
FIG. 9 shows an oil hydraulic circuit of the third embodiment of a hydraulic drive unit of a press machine of the present invention.
Figure 10:
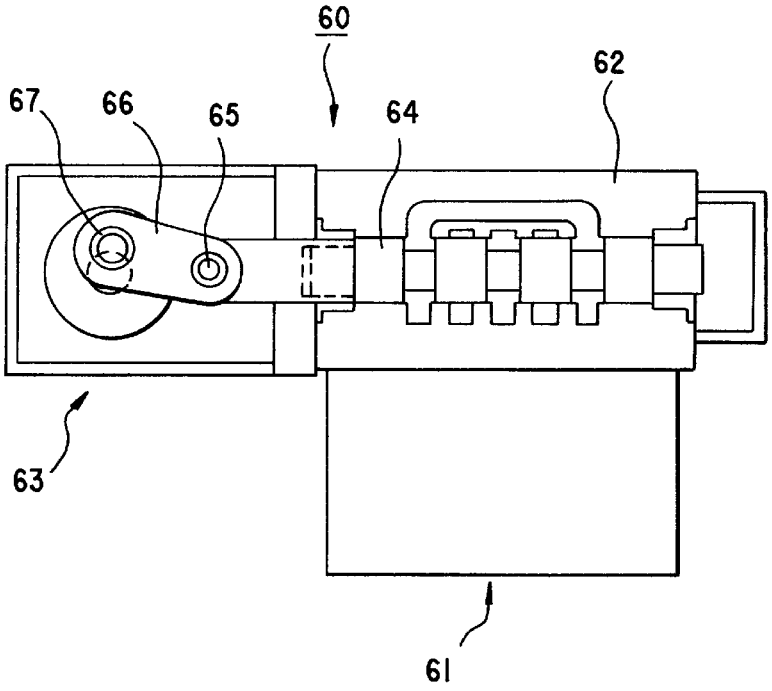
FIG. 10 shows a front sectional view that shows a selector device to use for the device of FIG. 9.
Figure 11:
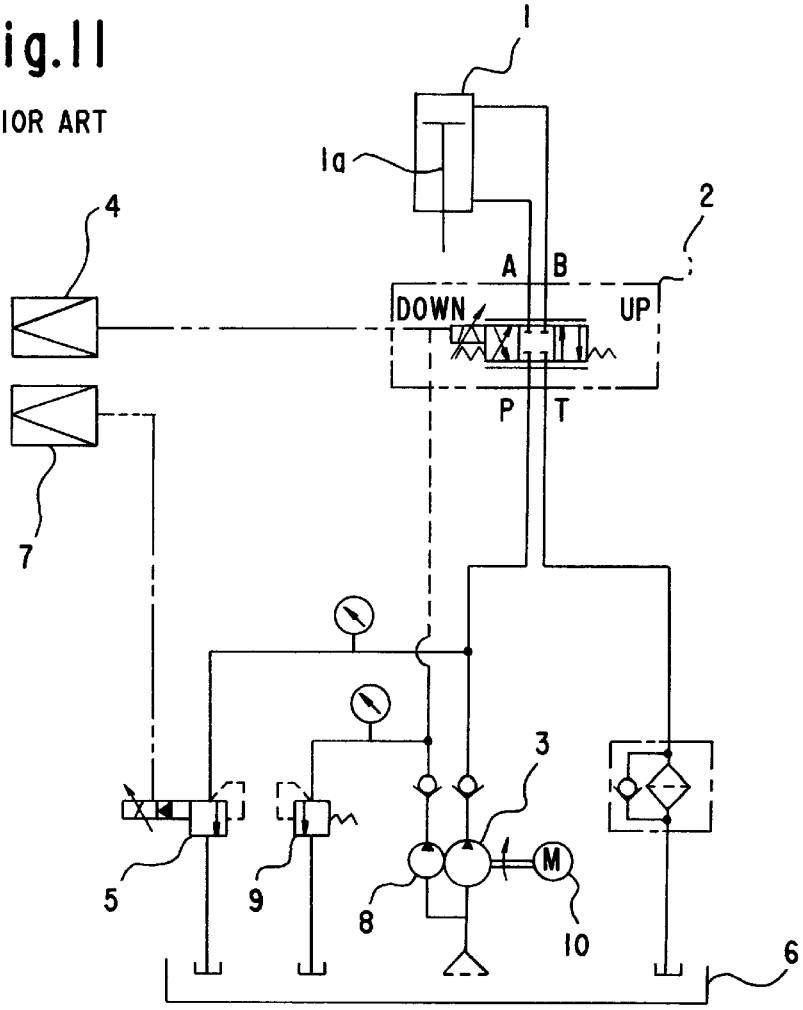
Fig.11 PRIOR ART
FIG. 11 shows an oil hydraulic circuit figure of a hydraulic drive unit of a press machine of a related art in which a servo valve is used.

FIG. 9 shows an oil hydraulic circuit of the third embodiment of a hydraulic drive unit of a press machine of the present invention. FIG. 10 shows a front sectional view that shows a selector device to use for the device of FIG. 9. The device of this embodiment has also a similar configuration with the above-mentioned first embodiment. But, a selector device has only one spool of three position four port as shown in FIG. 10.

The selector device 60 shown in FIG. 10 comprises a valve body 61 and an actuation control device 63 attached outside a casing 62 of the valve body 61. Only one spool 64 of three position four port is set up in the inside of the valve body 61. The edge of the spool 64 is connected with the crank shaft 67 arranged in the inside of the actuation control device 63 through a pin 65 and a connecting rod 66. A crank shaft 67 is driven with the electric motor 47 such as a servomotor and the reduction gears (not illustrated; it is connected in the inside way as the embodiment shown in the FIG. 5). As same with the second embodiment, a P-port and a T-port are connected in the inside of the selector device 60. Namely, when all ports are blocked, the pressure of the pipe line system does not rise up.

As for this embodiment, the electric motor 31 of the axial piston pump 11 and the electric motor 47 of the selector device 60 can be controlled cooperatively based on the command from the numerical control device 14. Therefore, the discharge of the axial piston pump 11 and the direction of working fluid to the hydraulic cylinder 1 are controlled cooperatively. Therefore, the hydraulic cylinder 1 can be driven without squeezing the working fluid vomited from the axial piston pump 11. Working fluid returned to the tank 6 through the relief valve 13 hardly occurs. Thus, the power efficiency as a system improves.

What is claimed is:

1. A hydraulic drive unit of a press machine comprising:

a hydraulic pump and a selector, said hydraulic pump being a swash plate type variable capacity axial piston pump having a discharge port, and said selector being a spool valve comprising a pair of spools in parallel, each spool having a P-port and a T-port wherein each P-port is connected with said discharge port;

a variable means made to vary an angle of inclination of the swash plate to control the discharge of said axial piston pump, said variable means comprising;

a piston which locates an angle of inclination of said swash plate by its one end touching with said swash plate, a first movement conversion means that is connected with another end of said piston to convert a rotation or oscillation movement to linear motion of said piston, a first actuator for rotation or oscillation connected with said first movement conversion means, a changeover drive means of said spool valve for alternating changeover actuation of the pair of spools such that discharge of the said hydraulic pump and a discharge direction of working fluid can be controlled cooperatively, said changeover drive means comprising a second movement conversion means that is connected with one end of each of said spools to convert rotating motion to linear motion, said second movement conversion means including a pair of cams, the cams being arranged corresponding with the pair of spools, each of the cams having a portion by which the spool corresponding therewith is moved and another portion by which said spool is not moved, the cams being arranged so that said portions make a phase difference of 180 degrees for actuating said changeover action of said pair of spools alternately, and a second actuator for rotation or oscillation connected with said second movement conversion means, and control means for cooperatively controlling actuation of said first and second actuator.

2. A hydraulic drive unit of a press machine of claim 1, wherein said P-port and said T-port are connected inside each said spool valve, so that when said changeover drive means is off working fluid discharged from said hydraulic pump to said P-port is returned to a source of supply of working fluid through said T-port.

3. A hydraulic drive unit of a press machine comprising:

a hydraulic pump and a selector, said hydraulic pump being a swash plate type variable capacity axial piston pump having a discharge port, and said selector being a spool valve comprising one spool having a P-port and a T-port wherein said P-port is connected with said discharge port;

a variable means made to vary an angle of inclination of the swash plate to control the discharge of said axial piston pump, said variable means comprising;

a piston which locates an angle of inclination of said swash plate by its one end touching with said swash plate, a first movement conversion means that is connected with another end of said piston to convert a rotation or oscillation movement to linear motion of said piston, a first actuator for rotation or oscillation connected with said first movement conversion means, a changeover drive means of said spool valve for changeover actuation of said spool such that discharge of the said hydraulic pump and a discharge direction of working fluid can be controlled cooperatively, said changeover drive means comprising a second movement conversion means that is connected with one end of said spool to convert rotating motion to linear motion, and a second actuator for rotation or oscillation connected with said second movement conversion means, and control means for cooperatively controlling actuation of said first and second actuator, wherein said P-port and a T-port are connected inside said spool valve, so that when said changeover drive means is off, working fluid discharged from said hydraulic pressure pump is returned to a source of supply of working fluid through said T-port from said P-port.

* * * * *